US008091929B2

(12) United States Patent
Lorch

(10) Patent No.: US 8,091,929 B2
(45) Date of Patent: Jan. 10, 2012

(54) HOLDING DEVICE FOR A SHOWER ATTACHMENT

(75) Inventor: Werner Lorch, Schramberg (DE)

(73) Assignee: Hansgrohe AG, Schiltach (DE)

( * ) Notice: Subject to any disclaimer, the term of this patent is extended or adjusted under 35 U.S.C. 154(b) by 832 days.

(21) Appl. No.: 10/566,636

(22) PCT Filed: May 25, 2004

(86) PCT No.: PCT/EP2004/005591
§ 371 (c)(1),
(2), (4) Date: May 5, 2006

(87) PCT Pub. No.: WO2005/021879
PCT Pub. Date: Mar. 10, 2005

(65) Prior Publication Data

US 2006/0277676 A1 Dec. 14, 2006

(30) Foreign Application Priority Data

Jul. 29, 2003 (DE) ..... 103 35 652

(51) Int. Cl.
*F16L 37/00* (2006.01)

(52) U.S. Cl. ..... 285/307; 285/394

(58) Field of Classification Search ..... 292/256, 292/DIG. 4; 285/309, 394, 302, 307, 82, 285/83
See application file for complete search history.

(56) References Cited

U.S. PATENT DOCUMENTS

| | | | | |
|---|---|---|---|---|
| 3,817,247 | A * | 6/1974 | Mills | 604/150 |
| 4,306,688 | A * | 12/1981 | Hechler, IV | 242/397 |
| 4,403,654 | A * | 9/1983 | Haynes | 166/73 |
| 4,543,982 | A * | 10/1985 | Wolfe | 137/355.21 |
| 4,582,257 | A * | 4/1986 | Siegler | 239/197 |
| 4,813,627 | A * | 3/1989 | Nelson | 242/373 |
| 4,827,538 | A * | 5/1989 | Heimann et al. | 4/677 |
| 5,093,942 | A * | 3/1992 | Lang | 4/541.6 |
| 5,279,324 | A * | 1/1994 | Schutz et al. | 137/48 |
| 5,518,023 | A * | 5/1996 | Garcia | 137/355.26 |
| 5,568,824 | A * | 10/1996 | Cordrey | 137/355.27 |
| 6,234,417 | B1 * | 5/2001 | Sauder et al. | 242/381 |
| 6,360,757 | B1 * | 3/2002 | Bohrer | 134/113 |
| 6,370,713 | B2 * | 4/2002 | Bosio | 4/677 |
| 6,381,770 | B1 * | 5/2002 | Raisch | 4/570 |
| 6,381,774 | B1 * | 5/2002 | Wales | 4/678 |
| 6,622,595 | B1 * | 9/2003 | Federighi | 81/3.48 |

(Continued)

FOREIGN PATENT DOCUMENTS

BE 424812 A 12/1937

(Continued)

OTHER PUBLICATIONS

German Search Report 103 35 652.5; May 11, 2004.

*Primary Examiner* — Aaron Dunwoody
(74) *Attorney, Agent, or Firm* — Duane Morris LLP

(57) ABSTRACT

A feed-through for a shower hose contains in the feed-through a securing mechanism, which is configured such that it definitely allows the hose to be pulled out, yet prevents it from being pulled back. In order to release the securing mechanism, a second tug is made on the hose, so that, when it is next pulled back, it can then be pulled inward through the feed-through.

17 Claims, 4 Drawing Sheets

U.S. PATENT DOCUMENTS

| | | | | |
|---|---|---|---|---|
| 6,738,996 | B1 * | 5/2004 | Malek et al. | 4/677 |
| 6,757,921 | B2 * | 7/2004 | Esche | 4/677 |
| 6,834,813 | B1 * | 12/2004 | Nobi | 239/197 |
| 6,857,583 | B2 * | 2/2005 | Attar | 239/332 |
| 7,000,854 | B2 * | 2/2006 | Malek et al. | 239/445 |
| 7,191,475 | B1 * | 3/2007 | Marcotte | 4/567 |
| 7,707,664 | B1 * | 5/2010 | Flynn | 4/570 |

FOREIGN PATENT DOCUMENTS

| | | | |
|---|---|---|---|
| DE | 28 50 647 | A1 | 6/1980 |
| DE | 39 01 007 | A1 | 7/1989 |
| DE | 38 12 399 | A1 | 10/1989 |
| EP | 0 486 000 | A1 | 5/1992 |
| EP | 0791553 | A1 | 8/1997 |

* cited by examiner

HOLDING DEVICE FOR A SHOWER ATTACHMENT

The invention relates to a holding device for a shower hose, in particular a shower hose for use in a washstand or the like.

It is known that, especially in horizontal-running washstands, the hand shower is supplied with water via a hose which is led through a feed-through in the washstand. When not in use, the hand shower sits in the feed-through itself and the hose hangs down beneath the washstand. Often an apparatus is present for pulling the hose back through the feed-through (DE 3901007).

It has been shown that the automatic retraction of the shower hose can sometimes be annoying, especially if the hose is only briefly put aside to do something else. On the other hand, the retraction of the hose is, in itself, very sensible.

The object of the invention is to provide a facility for improving the usage advantages of such a hand shower.

In order to achieve this object, the invention proposes a holding device having the features stated in claim 1. Refinements of the invention are the subject of subclaims.

In the case of horizontal-running washstands in which the feed-through therefore runs vertically, the hose is frequently retracted under its own weight. Through the fitting of a retaining mechanism, it now becomes possible to prevent the automatic retraction. The retaining mechanism provided for this purpose is sensible, of course, not only for use in horizontal-running washstands with vertically running feed-through, but also in all types of hose devices in which the hose is required to be retracted for practicability reasons. The invention combines the advantage of automatic retraction of the hose with the facility to switch off this automatic mechanism under certain circumstances.

According to the invention, it can be envisioned in a refinement of the invention that the retaining mechanism is disposed on or in the feed-through element. There is therefore no need for any additional devices which are visible at least on the outside and which would complicate or add to the cost of the construction.

The invention proposes that the coupling can be actuated manually by action upon the feed-through element itself. This could be done such that, for example, the retraction is normally prevented, yet that the retraction could be triggered by actuating an actuating element or even just by twisting a part of the feed-through element.

The retaining mechanism serves primarily, of course, to prevent the retraction of the hose. It is also conceivable, however, to design a retaining mechanism such that it prevents movement of the hose in both directions.

In a further refinement, it can be envisioned that the coupling for the release or actuation of the retaining mechanism can be actuated by manipulation of the hose itself.

This could be done, for example, such that a quick release of the hose always results in locking, which can be unlocked again by a short tug on the hose. A slow release of the hose could then lead to automatic retraction.

Another option also proposed by the invention consists in designing the coupling such that it are released by pulling on the hose and re-actuated by renewed pulling on the hose.

A third option for actuating the coupling by pulling on the hose can consist in a short tug releasing the coupling, while a pull over a longer distance causes it to engage.

The retaining mechanism can achieve the securement of the hose in the at least one direction in a wide variety of ways. Since a shower hose usually consists of a rubbery material, for its securement a force closure can be used which somewhat deforms the shower hose. A relatively simple design can achieve this.

Another option for retaining the shower hose consists in it being held at least partially by form closure. This option lends itself to standardly coiled or ribbed shower hoses.

Since the retaining mechanism is meant to be able also to free the hose again by use of the coupling, it can be configured, for example, such that it arrests the hose only in a certain rotary position of the hose relative to the retaining mechanism, while in another rotary position it lets it through. Here the decoupling would also consist in twisting the shower hose, or a part connected to the shower hose, by a certain angle.

For the realization of such a design, it can be envisioned that the retaining mechanism has a sleeve, which, at one position at least, has an inwardly projecting oblique surface. This oblique surface can be perceived as a wedge surface or as a cam, which another part can run up against in order thereby to arrest the hose.

In the rest of the circumferential region, the sleeve can have a configuration in which the internal diameter is not reduced, i.e. remains, for example, cylindrical.

In one refinement, the retaining mechanism can have a clamping sleeve, which is guided in the outer sleeve so as to be movable to a limited degree and, at one circumferential position at least, has a projection protruding outward over the rest of the clamping sleeve.

This projection can cooperate with the oblique surface of the outer sleeve to produce the clamping effect.

The outer sleeve of the securing mechanism can, in particular, form a part of the feed-through element.

The projection of the clamping sleeve can extend, for example, only over a part of the circumference of the clamping sleeve, while no projection is then present over the rest of the circumference. A plurality of such projections can also be present.

The circumferential extent of the projections, or, indeed, of just a single projection, can advantageously be chosen such that it is smaller than the gap between the oblique surfaces of the outer sleeve measured in the circumferential direction. The clamping sleeve can then be twisted into a position in which no engagement exists between the projections and oblique surfaces, which therefore corresponds to a release position. In another rotary position, the engagement then occurs.

In a further refinement of the finding, the projection can be arranged so as to be movable in the radial direction, for example configured on a flexible part. When the projection moves radially inward, a part connected thereto, or, indeed, its radial inner side, can enter into a force closure and/or form closure with the hose led through the clamping sleeve. The cooperation between projection and oblique surface therefore also simultaneously results in the clamping sleeve being secured on the hose.

For example, the projection can be configured on a molded-on tongue of the clamping sleeve. This tongue can additionally also serve to produce a slight force closure between the hose and the clamping sleeve in the longitudinal direction of the hose.

It is likewise possible and lies within the scope of the invention that the at least one projection is configured on a separate component, which is then fitted to the clamping sleeve. This separate component, too, can be configured such that rear side of the projection simultaneously forms the part which enters into force closure and/or form closure with the shower hose.

The clamping sleeve, which forms a part of the retaining mechanism, can be designed such that, when the hose is moved, it is carried along with it, at least in the longitudinal direction of the hose. The coupling can thereby be actuated by movement of the hose.

In a further refinement of the invention, between the outer sleeve and the clamping sleeve a connecting link guide can be present, which aligns the at least one projection of the clamping sleeve alternately either with the oblique surface of the outer sleeve or with the interspace between the oblique surfaces.

This connecting link guide can have, for example, a connecting link on the outer sleeve and at least one pin on the clamping sleeve, which pin cooperates with the connecting link. In particular, the connecting link guide can be configured such that it extends over a full circumference, i.e. allows the clamping sleeve to be fully twisted. When the hose is first pulled, the clamping sleeve is therefore brought outward into a position from which it is brought into the locking position when the hose is retracted. Upon repeated pulling of the hose, the clamping sleeve is then rotated once again, so that it then enters into the release position.

It would also be conceivable for the clamping sleeve, owing to the connecting link guide, to be rotated constantly to and fro.

Since only a small force closure is present between the clamping sleeve and the shower hose, the constant rotation in one direction does not, however, lead to torsioning of the hose, since this can reset itself over and over again.

Further features, details and preferences of the invention emerge from the claims and the abstract, both of whose wording is formulated by reference to the content of the description, the following description of preferred embodiments of the invention and with reference to the drawing, in which:

Figure 1:
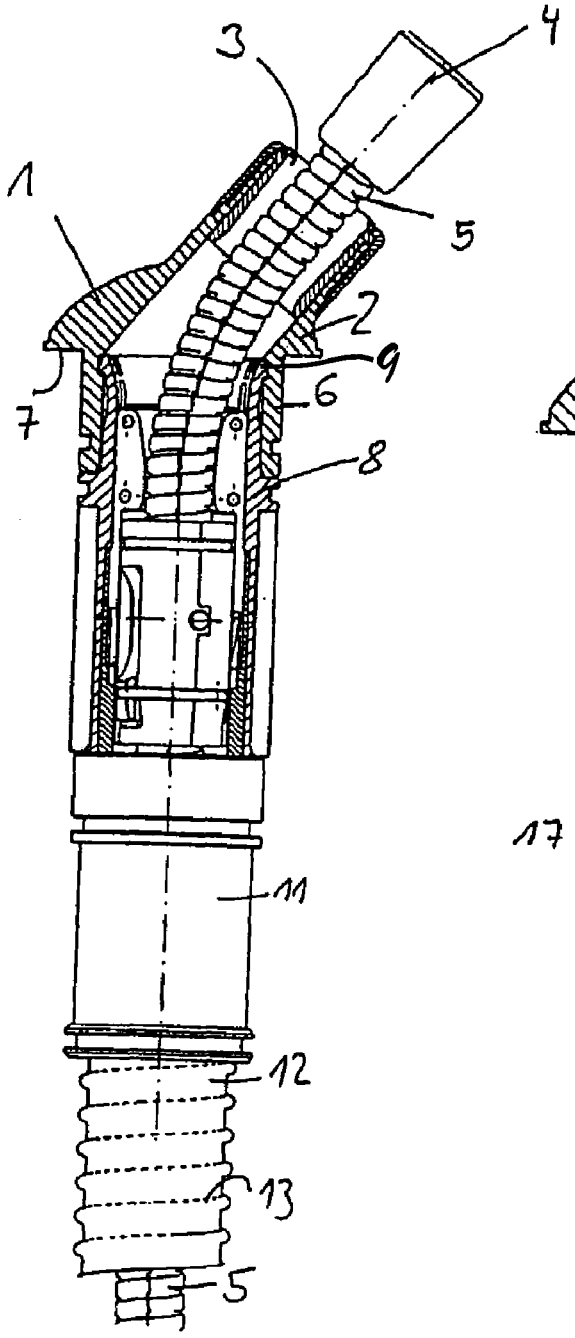
FIG. 1 shows schematically, in partially cut representation, the device for leading a shower hose through a horizontal-running board.

FIG. 1 shows a section through a holding device according to the invention. The holding device contains a feed-through element 1, which is configured for insertion into an opening in a horizontal-running board. The feed-through element 1 contains a part 2 to be disposed above the surface of the board and having an obliquely running mounting 3, into which the cone part 4, for example of a hand shower, can be inserted. This cone part 4 is retained in the mounting 3. The cone part 4 is formed by a union nut, which is fitted on the end of a shower hose 5. The shower hose 5 runs through the feed-through element 1. It contains below its visible part 2 a socket 6, which ends in a supporting shoulder 7.

Figure 2:
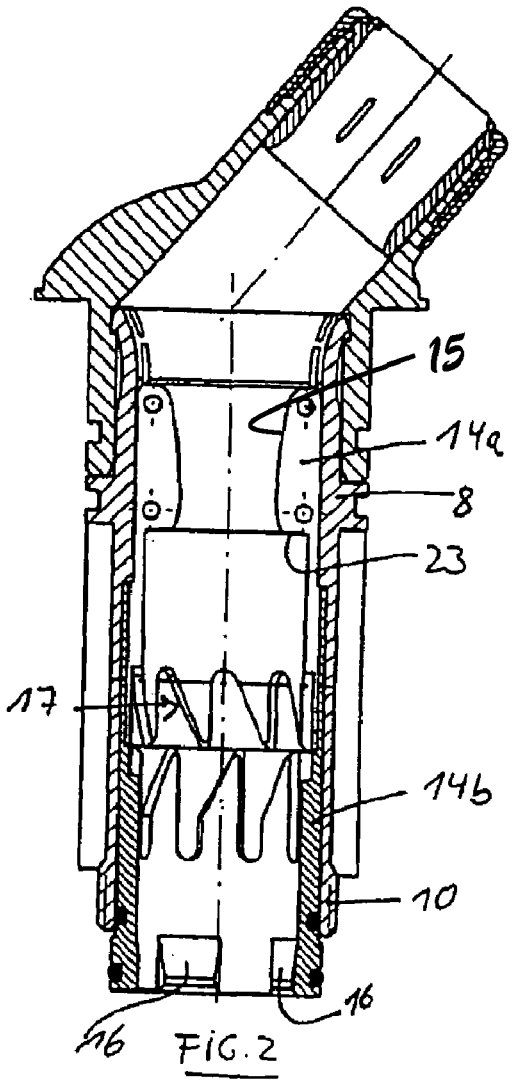
FIG. 2 shows, on an enlarged scale, the feed-through with the holding device.

Inserted from below into the feed-through part or its socket 6 is an extension part 8, which is snap-locked with a circumferential rim 9 into the inner side of the socket 6. The extension part 8 ends in a lug having an external thread 10, see FIG. 2. Screwed into this external thread 10 is a coupling sleeve 11 of a protective tubing 12. The protective tubing 12 surrounds the shower hose 5. The protective tubing 12 contains inside it a helical compression spring, which rests against the upper end of the coupling sleeve 11, while at the lower end, it rests with a connector against the connecting part of the shower hose 5. The helical compression spring 13, which is only indicated, attempts to direct the shower hose 5 straight and consequently pulls it downward, so that the cone nut 4 is pulled into the mounting 3.

Figure 3:
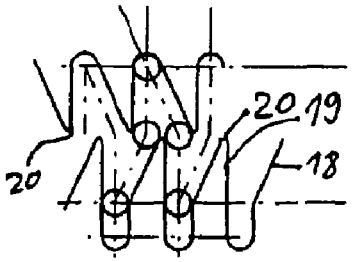
FIG. 3 shows, on an enlarged scale, a developed projection of the connecting link guide.

Inserted within the extension part 8 is an outer sleeve 14 of a retaining mechanism, which is made up of a top part 14*a* and a bottom part 14*b*. The top part 14*a* contains in its upper region a curved inner wall 15, against which the shower hose bears. In the region of the lower end, the bottom part 14*b* of the outer sleeve contains a plurality of inwardly directed projections 16, of which two are visible in FIG. 2. Disposed between the top and bottom part 14*a*, 14*b* of the outer sleeve 14 is a connecting link guide 17, which has a plurality of jags and depressions between the jags. A developed projection of the connecting link guide 17 is represented in FIG. 3.

The shape of the connecting link is now explained with reference to FIG. 3. The lower connecting link begins, starting on the right, with an oblique curve path 18, which is adjoined by a U with parallel side branches. The following side branch 19 again runs parallel to the longitudinal direction and ends in a peak 20, from which the curve path is repeated.

The opposite connecting link takes a similar course, the obliquely running portion, however, passing via an arc shape into the portion running parallel to the longitudinal direction.

The peaks 20 of each connecting link lie roughly in the middle between the peaks 20 of the respectively other connecting link. The two connecting links are thus, so to speak, staggered.

An indicated pin 21, situated in the lower connecting link, makes its way onto the oblique curve when pushed up, and then slides back into the lowest location on the other connecting link, whence it then slides back into the next depression of the connecting link. When an indicated pin 21 is pushed up and down, it is therefore advanced respectively by one depression. This constitutes, therefore, a stepping mechanism.

Figure 4:
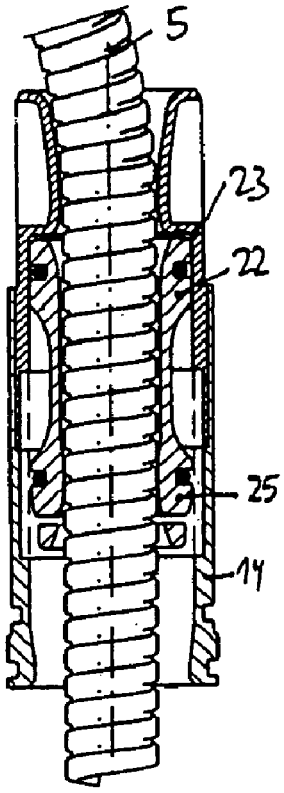
FIG. 4 shows the position between the hose and the retaining mechanism in the release position.
Figure 5:
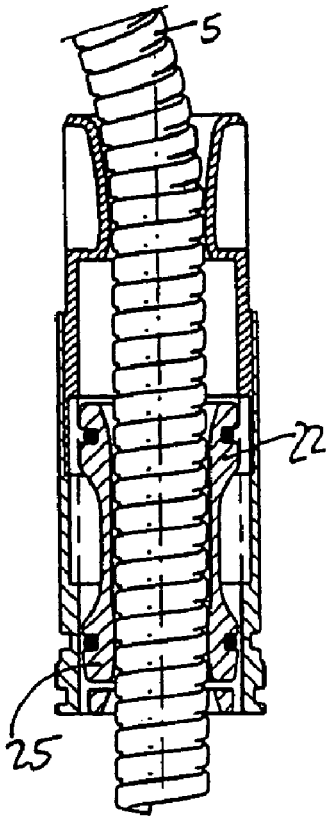
FIG. 5 shows the position of the shower hose as it is retracted.
Figure 6:
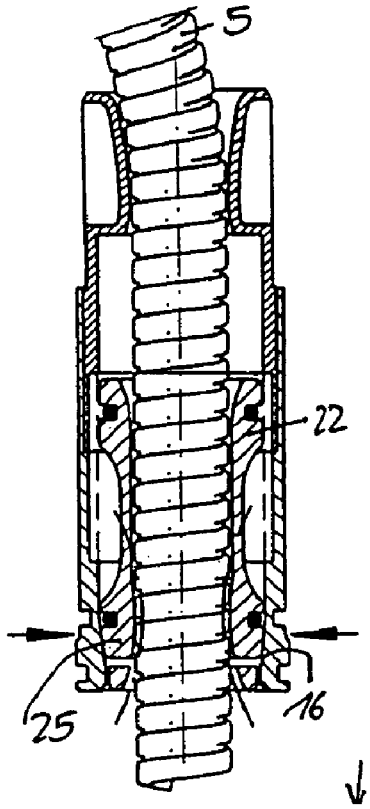
FIG. 6 shows the position of the shower hose in the clamped setting.

FIGS. 4 to 6 now show the interaction of the hose 5, a clamping sleeve 22 and the outer sleeve 14 in various stages. On the outer side of the hose 5 there is disposed a clamping sleeve 22, which is secured by force closure on the hose 5. This can best be seen in FIG. 7. If the hose is now pulled out of the feed-through element, then the clamping sleeve 22 is pushed upward until it comes to bear against a shoulder 23 of the outer sleeve. Its further displacement is thereby limited. The hose 5 can be pulled further out of the feed-through element. Since the force with which the clamping sleeve is secured on the hose 5 is only small, the further withdrawal of the hose 5 is scarcely hindered.

If the hose is now pulled by the aforementioned spring 13 back into the feed-through element, for example because the user lets go of the hand shower, then there are in principle two options for the further procedure. Depending on the original position of the pin 21 in the connecting link, the situation represented in FIG. 5 can now arise, in which the clamping sleeve 22 is pushed downward. In this position, the hose can be pulled fully and without hindrance through the feed-through element.

In another positions, in which the clamping sleeve 22 is twisted somewhat about the longitudinal axis of the hose, the condition represented in FIG. 6 arises. Here, parts of the clamping sleeve 23 bear against the aforementioned projections 16 on the inner side of the outer sleeve 14, so that these parts are now pressed up against the hose and secure this. This constitutes, therefore, the locking setting of the retaining mechanism, in which the hose cannot be pulled further through the feed-through element.

Figure 7:
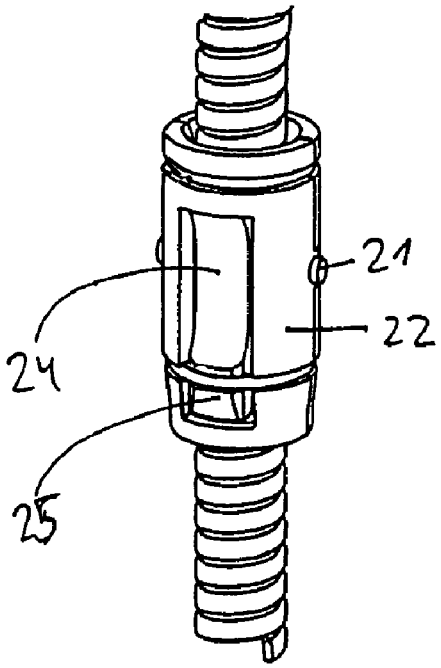
FIG. 7 shows the perspective view of a clamping sleeve placed onto the shower hose.

Reference has already been made to FIG. 7, where the arrangement of the clamping sleeve 22 on the outer side of the hose 5 is represented. Roughly in the middle between the two pins 21, the clamping sleeve has notches having resilient tongues 24. At their upper end assigned to the hand shower, these resilient tongues 24 are molded integrally on the clamping sleeve 22, but are free in the region of their lower end. In the region of their lower end, they project somewhat over the outer contour of the clamping sleeve 22. Owing to the material properties, these tongues 24 are somewhat resilient, so that the deformations which are evident in the comparison between FIGS. 4 and 6 are easily possible.

Figure 8:
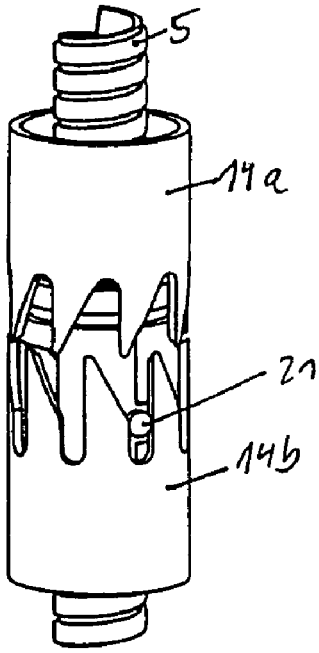
FIG. 8 shows the representation of FIG. 7 with outer sleeve threaded over the clamping sleeve.
Figure 9:
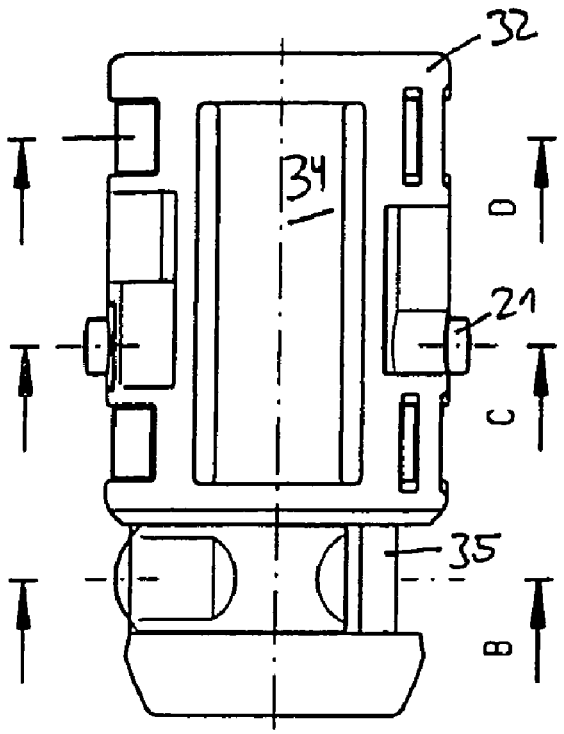
FIG. 9 shows a side view of a second embodiment of the clamping sleeve.
Figure 10:
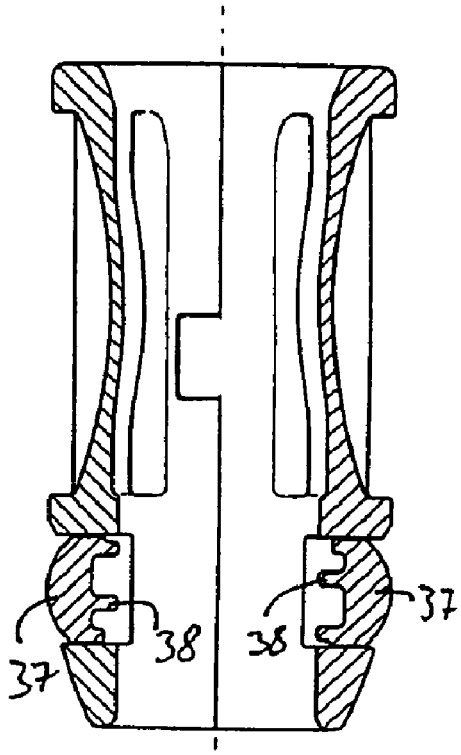
FIG. 10 shows a longitudinal section through the clamping sleeve of FIG. 9.

Disposed within the feed-through element is the outer sleeve, which, in the representation of FIG. 8, is mounted on the clamping sleeve 22. It can here be seen that the pins 21 engage in the connecting link on the connecting link guide. An axial movement of the hose 5 therefore results in the clamping sleeve also being twisted, respectively, upon its axial displacement.

The projections 25 formed on the ends of the tongues 24 have a circumferential extent which is roughly equal to the distance between two inwardly directed oblique surfaces 16 of the outer sleeve 14. Depending on the orientation, the projection 25 can thereby be aligned with the interspaces between the oblique surfaces 16, see FIG. 5, with the result that the hose can be pushed through the clamping sleeve.

Upon twisting, the projections 25 of the tongues 24 then enter into an angular position in which they are aligned with the oblique surfaces 16. This is represented by FIG. 6. Here, the projections 25 bear against the oblique surfaces 16. The more strongly the hose is pulled downward, the stronger the radial pressurization of the hose in the inward direction and hence its securement.

The retaining mechanism works, therefore, as follows. First the hose is pulled out, which is possible from all positions. When the hose is pulled back downward, caused by the spring 13, the position of FIG. 6, for example, is reached, which represents a retention of the hose. In order then to free the hose again, the user needs only to tug briefly on the hose, until the clamping sleeve is twisted by its pins 21 by the connecting link guide to the point where, when the hose is released, the position of FIG. 5 is assumed. The hose 5 can then be pulled through the clamping sleeve and hence through the feed-through without hindrance.

Whereas, in the embodiment of FIGS. 4 to 8, the projections 25 are disposed on the ends of one-piece tongues 24, the following figures show a clamping sleeve which is somewhat differently constructed.

Like in the preceding embodiment, the clamping sleeve 32 consists of two parts, which are identically constructed and can be snap-locked together. The clamping sleeve 32 has on its outer side two diametrically disposed pins 21, which have the same function as in the preceding embodiment. Disposed in the notches, once again, are tongue-like configurations 34, which, however, on both end faces, are integrally connected to the clamping sleeve 32. These slightly inwardly preformed tongues 34 serve solely to secure the clamping sleeve 32 on the hose. This securement is necessary in order that the advancement of the clamping sleeve by the connecting link guide is at all possible.

The clamping sleeve 32 has in its lower end region, i.e. that which is assigned to the installation end of the hose, a circumferential groove 35, in which a clip 36 is snap-locked. The clip 36 extends over roughly half the circumference. It is secured in the axial direction by the groove 35. In the region of its two ends it has respectively a projection 37, see FIG. 11, the projection 37 being dimensioned such that it projects over the rest of the circumference of the clamping sleeve in the lower region. The two projections 37 assume the function of the projections 25 in the embodiment according to FIGS. 4 to 7. On the inner sides of the clips 36 lying opposite the projections, two axially offset ribs 38 are configured, the axial offset of these two ribs 38 corresponding to about half the pitch of the coil of a standard shower hose. It is apparent from FIGS. 4 to 7 that the shower hose has a type of thread. When the projections 37 are displaced inward, the ribs 38 come to lie between two windings of the shower hose 5, so that they thereby achieve a positive securement of the shower hose in relation to the clamping sleeve 32.

Figure 11:
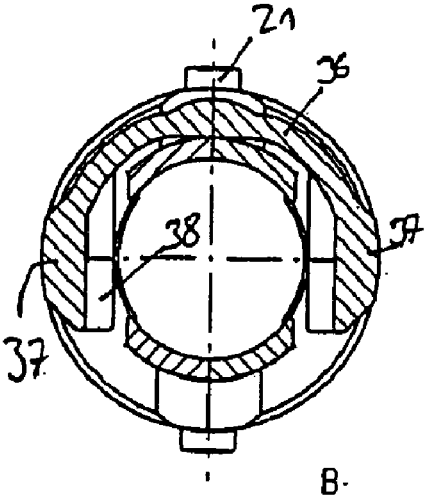
FIG. 11 shows a cross section through the clamping sleeve of FIG. 9 along the line XI-XI.
Figure 12:
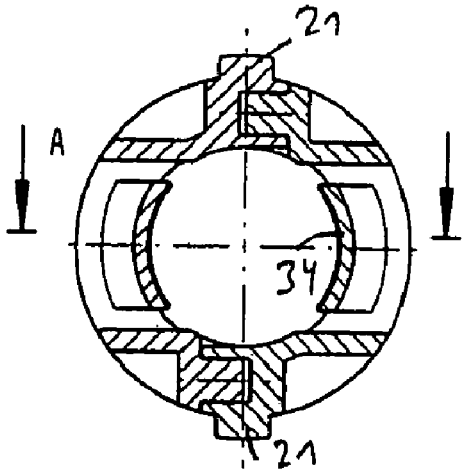
FIG. 12 shows a second cross section through the clamping sleeve of FIG. 9 along the line XII-XII.
Figure 13:
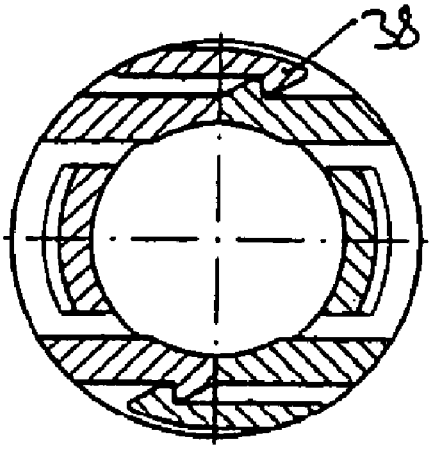
FIG. 13 shows a third cross section through the clamping sleeve of FIG. 9 along the line XIII-XIII.

FIG. 13, which, like FIGS. 11 and 12, shows a cross section through the clamping sleeve 32, shows how the two parts of the clamping sleeve are fastened together. Each half of a clamping sleeve has a resilient projection 38, which engages with a boss behind an undercut in the respectively other half of the clamping sleeve.

Figure 14:
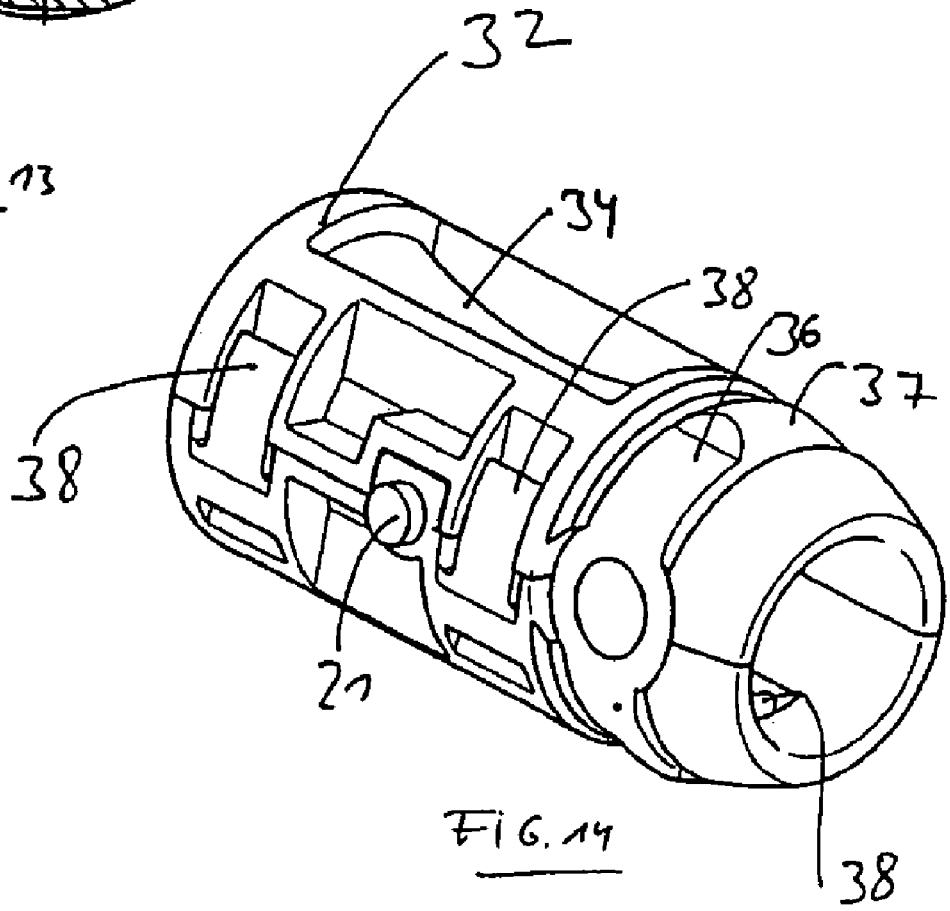
FIG. 14 shows a perspective view of the clamping sleeve of FIGS. 9 to 13.

FIG. 14 shows once again, in perspective view, a clamping sleeve 32 of the embodiment according to FIGS. 9 to 13.

What is claimed is:

1. A holding device for a shower hose, comprising:

a feed-through element, a shower hose with a union for a shower head, the shower hose being led through the feed-through element and movable through the feed-through element from a position at which the union is at the feed-through element, outwardly to a longitudinal position along the hose at which the union is spaced from the feed-through element, a retaining mechanism disposed in the feed-through element, the retaining mechanism having a detachable coupling structured to couple and decouple with the shower hose for arresting and releasing the hose for movement relative to the feed-through element, wherein the shower hose can be pulled longitudinally outwardly from the feed-through element to said longitudinal position, and the hose can be retained at said longitudinal position by selectively coupling the retaining mechanism in the feed-through element with the hose, and wherein the hose can be allowed to retract inwardly from said longitudinal position through the feed-through element by selectively decoupling the retaining mechanism, and, wherein the detachable coupling of the retaining mechanism is actuated for said coupling and decoupling, by manual manipulation of the shower hose that causes the retaining mechanism to engage with the feed-through element.

2. The holding device as claimed in claim 1, wherein the coupling comprises relatively movable parts that are released from the shower hose by pulling outwardly on the shower hose and engaged by renewed pulling after release.

3. The holding device as claimed in claim 1, wherein the detachable coupling comprises a clamping sleeve configured to secure the shower hose at least partially by force closure applied laterally inwardly on the shower hose.

4. The holding device as claimed in claim 1, wherein the shower hose has at least one of a ribbed and coiled form, and the detachable coupling secures the shower hose at least partially by form closure with the shower hose form.

5. The holding device as claimed in claim 1, wherein the retaining mechanism comprises relatively rotatable parts configured such that the retaining mechanism secures the shower hose only in a certain rotary position and in another rotary position lets the shower hose through, and wherein said parts are relatively rotated by engagement of the retaining mechanism and the feed-through element.

6. The holding device as claimed in claim 1, wherein the retaining mechanism has a sleeve, which, at one position at least, has an inwardly projecting oblique surface.

7. The holding device as claimed in claim 6, wherein, in the rest of a circumferential region apart from the inwardly projecting oblique surface, the sleeve has a configuration in which the internal diameter is not reduced.

8. The holding device as claimed in claim 6, wherein the sleeve comprises an outer sleeve and the retaining mechanism has a clamping sleeve, which is guided in the outer sleeve so as to be movable to a limited degree and, at one circumferential position at least, has an outwardly protruding projection.

9. The holding device as claimed in claim 8, wherein a circumferential extent of the projection is smaller than a circumferential extent of a portion of the outer sleeve that is free from the oblique surface.

10. The holding device as claimed in claim 8, wherein the projection is configured so as to be flexible in a radial direction.

11. The holding device as claimed in claim 10, wherein the projection, upon radial movement inward, enters into at least one of force and form closure with the shower hose (5) led through the clamping sleeve.

12. The holding device as claimed in claim 8, wherein the projection is configured on a molded-on tongue of the clamping sleeve.

13. The holding device as claimed in claim 8, wherein the projection is configured on a separate component.

14. The holding device as claimed in claim 1, wherein the clamping sleeve is configured such that, when the shower hose is moved, the clamping sleeve is carried along with the shower hose in a longitudinal direction.

15. The holding device as claimed in claim 8, comprising a connecting link guide between the outer sleeve and the clamping sleeve, which aligns at least one said projection of the clamping sleeve alternately with at least one said oblique surface and an interspace with the at least one said oblique surface.

16. The holding device as claimed in claim 15, wherein the connecting link guide has a connecting link on the outer sleeve and at least one pin on the clamping sleeve.

17. The holding device as claimed in claim 15, wherein the connecting link guide allows a full rotation of the clamping sleeve.

* * * * *